US010064430B2

(12) United States Patent
Ugurhan

(10) Patent No.: US 10,064,430 B2
(45) Date of Patent: Sep. 4, 2018

(54) SMOKING ARTICLE FOR A WATER-PIPE

(71) Applicant: JT International S.A., Geneva (CH)

(72) Inventor: Yilmaz Ugurhan, Konz (DE)

(73) Assignee: JT International S.A. (CH)

( * ) Notice: Subject to any disclaimer, the term of this patent is extended or adjusted under 35 U.S.C. 154(b) by 97 days.

(21) Appl. No.: 14/912,863

(22) PCT Filed: Jul. 7, 2014

(86) PCT No.: PCT/EP2014/064429
§ 371 (c)(1),
(2) Date: Feb. 18, 2016

(87) PCT Pub. No.: WO2015/024697
PCT Pub. Date: Feb. 26, 2015

(65) Prior Publication Data

US 2016/0192702 A1 Jul. 7, 2016

(30) Foreign Application Priority Data

Aug. 21, 2013 (EP) ..... 13181223

(51) Int. Cl.

| | |
|---|---|
| ***A24F 1/30*** | (2006.01) |
| ***A24F 1/16*** | (2006.01) |
| ***A24D 1/14*** | (2006.01) |
| ***A24B 13/00*** | (2006.01) |

(52) U.S. Cl.
CPC ..... *A24F 1/30* (2013.01); *A24B 13/00* (2013.01); *A24D 1/14* (2013.01)

(58) Field of Classification Search
CPC ..... A24F 1/30; A24B 13/00
USPC ..... 131/348
See application file for complete search history.

(56) References Cited

U.S. PATENT DOCUMENTS

| | | | | |
|---|---|---|---|---|
| 732,252 | A * | 6/1903 | Assman | A24F 1/28 131/191 |
| 4,708,151 | A | 11/1987 | Shelar | |
| 4,756,318 | A * | 7/1988 | Clearman | A24F 47/004 131/196 |
| 4,938,236 | A | 7/1990 | Banerjee et al. | |

(Continued)

FOREIGN PATENT DOCUMENTS

| | | |
|---|---|---|
| CA | 2599199 A1 | 2/2009 |
| EP | 2179667 A1 | 4/2010 |

(Continued)

OTHER PUBLICATIONS

Extended European Search Report for Appln. No. 13181223.2, dated Feb. 17, 2014.

(Continued)

*Primary Examiner* — Eric Yaary
*Assistant Examiner* — Russell E Sparks
(74) *Attorney, Agent, or Firm* — Lerner, David, Littenberg, Krumholz & Mentlik, LLP

(57) ABSTRACT

A smoking article, especially a smoking article in the form of a replaceable cartridge, pellet, or capsule for a water-pipe, includes a body of smoking material, such as tobacco or the like, and a heat source provided in the body for heating the smoking material, wherein the smoking article defines an airflow path for air to be heated by the heat source and to pass through the body of smoking material.

21 Claims, 4 Drawing Sheets

(56) References Cited

U.S. PATENT DOCUMENTS

| | | | | |
|---|---|---|---|---|
| 5,144,962 | A * | 9/1992 | Counts | A24F 47/008 128/200.14 |
| 5,240,012 | A * | 8/1993 | Ehrman | A24F 47/004 131/182 |
| 7,845,358 | B2 * | 12/2010 | Danforth | A24F 47/00 128/202.21 |
| 2003/0075188 | A1 * | 4/2003 | Adiga | A24F 47/004 131/185 |
| 2007/0283972 | A1 * | 12/2007 | Monsees | A24F 47/006 131/273 |
| 2008/0314401 | A1 * | 12/2008 | McLaughlin | A24D 3/041 131/335 |
| 2010/0059070 | A1 * | 3/2010 | Potter | A24F 47/004 131/194 |
| 2010/0101590 | A1 | 4/2010 | Pflaum | |
| 2011/0186061 | A1 | 8/2011 | Saleh | |
| 2015/0013697 | A1 * | 1/2015 | Mironov | A24B 15/165 131/328 |

FOREIGN PATENT DOCUMENTS

| | | | | |
|---|---|---|---|---|
| GB | 2490352 | A | 10/2012 | |
| JP | S62224277 | A | 10/1987 | |
| JP | H03112477 | A | 5/1991 | |
| WO | WO-2013120565 | A2 * | 8/2013 | A24D 3/04 |

OTHER PUBLICATIONS

International Search Report and Written Opinion for Appln. No. PCT/EP14/64429, dated Sep. 8, 2014.

European Office Action for Application No. 14735976.4, dated Oct. 10, 2017 (4 pages).

* cited by examiner

SMOKING ARTICLE FOR A WATER-PIPE

Priority is claimed under 35 U.S.C. § 119 to European Application No. 13181223.2 filed on Aug. 21, 2013 and under 35 U.S.C. § 365 to PCT/EP2014/064429 filed on Jul. 7, 2014.

FIELD OF THE INVENTION

The present invention concerns a smoking article, especially for smoking in a water-pipe. More particularly, the invention relates to a smoking article which may be formed as a cartridge, pellet, or capsule, for use in a portable water-pipe, such as a pocket-sized water-pipe.

BACKGROUND OF THE INVENTION

Recently, the smoking of water-pipes has gained significantly in popularity. This type of smoking experience is typically practised with a traditional water-pipe, variously known from near- and middle-eastern states, as well as from the Indian subcontinent, as a "hookah", "shisha" or "nargile" pipe. As traditional water-pipes are typically rather large and ornate devices, however, they are not very practical for portable use. For this reason, smaller portable water-pipes have also been developed by the present applicant.

SUMMARY OF THE INVENTION

One idea of the present invention is therefore to provide a new and improved smoking article that is especially suited to use with a water-pipe, especially with a portable water-pipe. In this regard, it would be useful to provide a new smoking article that can be employed as a replaceable cartridge or capsule for a water-pipe, thereby enabling consumers to more easily enjoy this type of smoking experience.

According to one aspect, therefore, the invention provides a smoking article, especially formed as a cartridge, pellet, or capsule, for smoking in a water-pipe, the smoking article comprising: a body of smoking material, such as tobacco or the like, and a heat source provided in the body for heating the smoking material. The smoking article defines an airflow path for air to be heated by the heat source and then to pass through the body of the smoking material. In this way, when a user of the smoking article inhales, air is drawn into the article and heated by the heat source before then passing through the smoking material. To this end, the airflow path may be designed such that the air may pass adjacent to or through the heat source in order to be heated. The heated air then desirably vaporizes (rather than burns) the smoking material as it passes through said body to produce smoke. The smoke is typically passed through the water of a water-pipe before it reaches the user.

In some embodiments of the invention, the heat source includes an element configured to transfer heat to air that flows along the airflow path. To this end, the element may be heatable and may include one or more channels for air to flow adjacent or through the element, with each channel forming a part of the airflow path. Indeed, the heatable element will typically include a plurality of air-flow channels extending generally parallel there-through. In some embodiments, the heat transfer element may be a fuel element, e.g. comprised of a combustible substance like, for example, a carbonized substance, such as charcoal or a carbonaceous heat source of the kind described in EP 2 443 947 A1. Such a fuel element may optionally include a flavour additive to avoid an undesirable taste being imparted to the air. In this embodiment, therefore, the one or more channels in the fuel element may be configured or arranged to promote or optimize not only a transfer of heat to the air passing through them, but also combustion of the fuel element. In alternative embodiments, however, each such element of the heat source may be electrically heatable.

In some embodiments, at least one baffle member is arranged to direct or guide a flow of air, e.g. in deflected or convoluted manner, through the smoking material along the airflow path. In this regard, the at least one baffle member may be provided in the body of smoking material to partially define the said airflow path. Accordingly, the baffle member(s) may be configured to distribute the heated air from the heat source through the smoking material, e.g. tobacco.

In some embodiments, an air chamber is provided in the airflow path between the heat source and the body of smoking material. In other words, the airflow path may include an air chamber located downstream of the heat source and upstream of the smoking material. In some embodiments, the air chamber is located below and/or laterally of the heat source and is in fluid communication with the body of smoking material, e.g. via perforations or holes in a barrier layer. In this way, the air chamber provides an area for the heated air to collect before that heated air passes into the smoking material. The air chamber may also serve to collect ash from combustion of a fuel element of the heat source and to retain or keep any such ash separate from the smoking material.

In this context, the smoking article may be configured such that the heat source (e.g. a fuel element) is held physically separate from the body of smoking material by a barrier, e.g. by a layer or sheet of barrier material, such as a foil or film, with the barrier preferably being thermally conductive. For example, a metal foil forming a barrier layer between the heat source and the body of smoking material may then conduct heat to the smoking material. Furthermore the body of smoking material may also be wrapped or covered with a protective barrier layer or film. The barrier material may, for example, include a metal-based foil, such as an aluminium foil. The barrier layer may be configured to include a support for the heat source (e.g. the fuel element) such that an air chamber is provided below the heat source. An outer or external thermally insulating layer, such as paper, may also be provided around an outside of the smoking article so that the smoking article is still able to be handled by a user while in use. That is, the outer layer may insulate the fingers of a user from extreme heat and thereby protect the user from being burnt.

In some embodiments of the invention, the heat source is substantially surrounded or encompassed by the body of smoking material. For example, the heat source may be positioned substantially centrally within the body of smoking material. In this regard, the body of smoking material may be provided in a prismatic or pellet-like form (e.g. preferably a substantially cylindrical form) and a heat transfer element may be in the form of a central rod or stud. For example, the diameter of the body of smoking material may be in the range of about 5 mm to 50 mm, and preferably in the range of about 10 mm to 20 mm, whereas a rod-like heat transfer element will preferably have a width in the range of 1 mm to 10 mm, and more preferably in the range of 2 mm to 5 mm.

In some embodiments, the smoking material includes one or more of the group consisting of: tobacco, glycerine (e.g. vegetable glycerine), propylene glycol (PG), cut filler, and a flavour additive. The glycerine and/or the propylene glycol may be present (e.g. combined with tobacco) in an amount ≥25% by mass, and preferably ≥50% by mass, of the body of smoking material.

In some embodiments, an outer or distal end region of the heatable element of the heat source projects out of the body of smoking material. In this way, where the heatable element is a fuel element comprising a combustible substance, an outer or distal end region of the element is readily accessible for ignition by a user. In some embodiments, the said outer or distal end region of the heatable element (e.g. the fuel element) includes a cover or screen to prevent direct contact therewith by a user. The cover or screen will typically include holes or apertures forming part of the airflow path.

In some embodiments of the invention, the heat source includes one or more heat transfer fins or plate members, which extend(s) from each heatable element or fuel element into the body of smoking material for conducting heat into the smoking material.

BRIEF DESCRIPTION OF THE DRAWINGS

For a more complete understanding of the invention and the advantages thereof, exemplary embodiments of the invention are explained in more detail in the following description with reference to the accompanying drawing figures, in which like reference characters designate like parts and in which.

DETAILED DESCRIPTION OF EMBODIMENTS OF THE INVENTION

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences while those skilled in the art will understand that such specificity with respect to sequence is not actually required. It will also be understood that the terms and expressions used in the present specification have the ordinary meaning as is accorded to such terms and expressions with respect to their corresponding respective areas of inquiry and study, except where specific meanings have otherwise been set forth herein.

Figure 1:
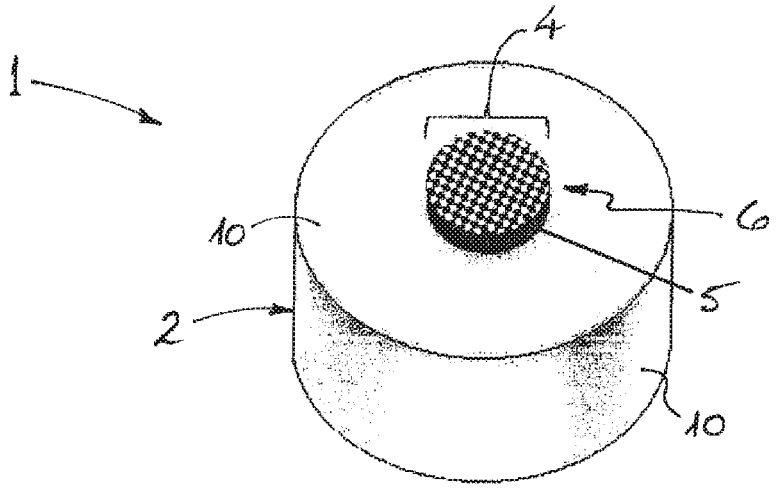
FIG. 1 is a schematic perspective view of a smoking article according to a first embodiment.
Figure 2:
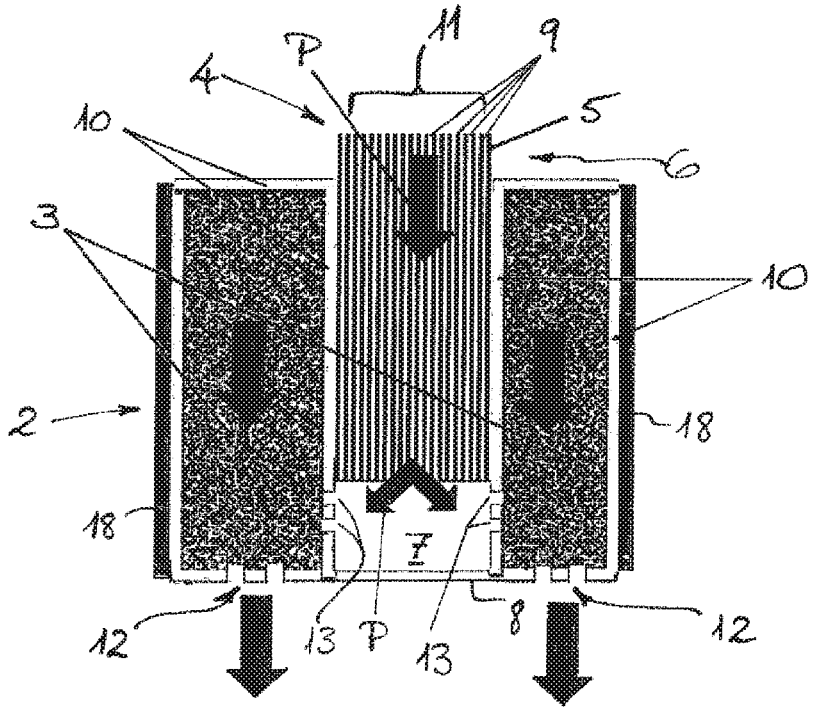
FIG. 2 is a cross-sectional view of the smoking article shown in FIG. 1.

Referring firstly to FIGS. 1 and 2 of the drawings, a smoking article 1 according to a first embodiment is provided in the form of a replaceable cartridge, pellet or capsule for use in a portable water-pipe (not shown). This replaceable cartridge or pellet-like smoking article 1 has a generally cylindrical shape and comprises a cylindrical body 2 of a material 3 to be smoked, such as tobacco with glycerine, propylene glycol, cut filler and/or flavour additive. Arranged centrally within the cylindrical body 2 of tobacco material 3, a heat source 4 is provided in the form of generally cylindrical or rod-like fuel element 5 of a combustible substance, such as charcoal. An upper end region 6 of the rod-like fuel element 5 projects upwardly beyond the cylindrical body 2 of smoking material 3 to facilitate a user igniting the heat source 4, e.g. using a match or a cigarette lighter.

As can be seen in FIG. 2 of the drawings, the rod-like fuel element 5 is embedded centrally within the cylindrical body 2 of the tobacco material 3 and extends substantially, but not entirely, through a vertical dimension of the cartridge 1. In particular, below the charcoal fuel rod 5 an air chamber 7 is provided at a base 8 of the smoking article 1. Furthermore, the fuel element 5 includes an array of parallel channels 9 which extend through it to provide for the passage or flow of air through the heat source 4 as the fuel element 5 burns. That is, air channels 9 extend in an axial or longitudinal direction from the upper end region 6 of the fuel element 5 in a straight and parallel manner to a lower end region where they communicate with the air chamber 7.

With further reference to FIGS. 1 and 2, the cylindrical body of the tobacco material 3 is wrapped or covered by a barrier layer 10, desirably of aluminium foil or sheet, which shields and protects the tobacco smoking material from moisture and impurities, and helps to maintain freshness of the smoking material. In this regard, the barrier layer 10 in a central region of the replaceable cartridge 1 physically separates or isolates the charcoal fuel element 5 from the tobacco material 3. At the same time, however, the barrier layer 10 is able to conduct heat from the burning fuel element 5 directly into the adjacent tobacco material 3.

An array of openings 11 at the upper end region 6 of the rod-like fuel element 5 forms an air inlet into the smoking article 1, and more particularly into the plurality of channels 9 through the rod during use. In a similar manner, a number of openings 12 in the base 8 of the cylindrical body 2 form an air outlet from the smoking article 1 during use. Thus, this cartridge-type smoking article 1 comprises or defines an airflow path P (i.e. denoted by the large arrows) between the inlet openings 11 and the outlet openings 12 via which air is able to be heated by the heat source 4 and then pass through the body 2 of smoking material or tobacco 3. In use, the cartridge 1 of this embodiment is placed in a water-pipe (not shown) with the outlet openings 12 in the base 8 of the body 2 arranged in fluid communication with a smoke channel of the water-pipe upstream of the water chamber. Then (or even before the cartridge 1 is placed in the water-pipe) the rod-like fuel element 5 of the heat source 4 is lit or ignited so that a gradual combustion of the fuel element 5 generates heat in the smoking article 1. In this way, when a user of the water-pipe inhales or draws air via a mouth-piece through the smoke channel, an under-pressure is created at the outlet openings 12, and this in turn induces an air-flow through the smoking article 1 along the airflow path P.

Thus, air which enters the article 1 at the inlet openings 11 and travels along the channels 9 is heated by the burning fuel element 5 as it passes to the air chamber 7. As can be seen in FIG. 2, holes or perforations 13 are provided in the barrier layer 10 communicating between the air chamber 7 and laterally adjacent cylindrical body 2 of smoking material 3. Accordingly, the heated air drawn through the fuel element 5 along the airflow path P by the under-pressure at the outlet openings 12 then passes through the holes or perforations 13 from the air chamber 7 into the smoking material 3. This air is heated to a temperature which contributes to the tobacco or smoking material 3 to generate smoke. In this procedure, it will be noted that the smoking material 3 is heated not only by the hot air emerging from the fuel element 5 and passing through the perforations 13, but also directly via conduction of heat by the aluminium foil 10 separating the burning fuel element 5 from the laterally adjacent smoking material 3 in the cylindrical body 2. The smoke created by the tobacco 3 then continues on the airflow path in the direction of arrows P through the outlet apertures or openings 12 in the base or lower region 8 of the smoking article 1. After that smoke exits the body 2 of the cartridge 1, it continues on through the smoke channel of the water pipe, via the water chamber to the mouth-piece to then be inhaled by the user.

Figure 3:
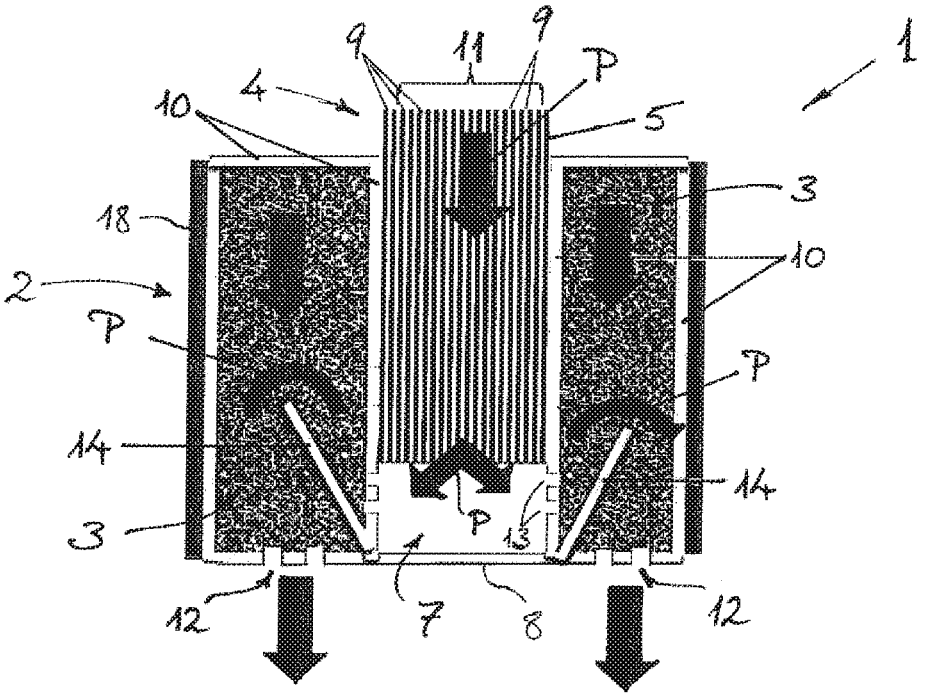
FIG. 3 is a cross-sectional view of a smoking article according to a second embodiment.
Figure 4:
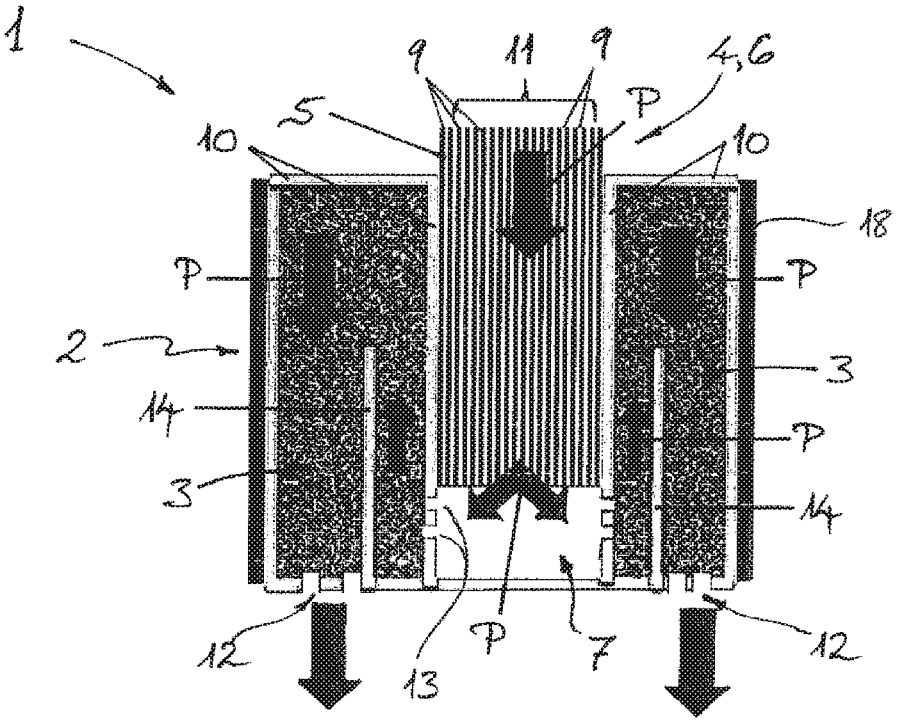
FIG. 4 is a cross-sectional view of a smoking article according to a third embodiment.

With reference to FIG. 3 of the drawings, a second embodiment of the smoking article 1 includes baffle members 14 arranged within the body 2 of tobacco material 3 for deflecting or guiding the airflow from the air chamber 7 in a somewhat more convoluted manner through the tobacco material. In this way, the baffle members 14 serve to better distribute the heated air through the tobacco material 3 as the smoking article 1 is being smoked. To do this, each baffle member 14 is pitched or inclined at an upwardly extending angle from the base 8 of the cartridge adjacent the air chamber 7 to a central region of the annular or cylindrical body 2 of smoking material 3. FIG. 4 of the drawings shows a variation of the embodiment in drawing FIG. 3, in which baffle members 14 are arranged to extend substantially vertically parallel to, and spaced from, the sides of the fuel element 5. In this way, the airflow path P continues along the heated aluminium barrier layer 10 next to the burning fuel element 5. Also, by extending higher within the annular body 2 of smoking material 3, the airflow path P extends and is distributed through a greater volume of the tobacco. It will be appreciated that what appears to be two baffle members 14 in FIGS. 3 and 4 may, in fact, be the laterally opposite sides of a single conical or cylindrical shaped baffle member 14 which extends concentrically within the cylindrical body 2 of tobacco material 3.

Figure 5:
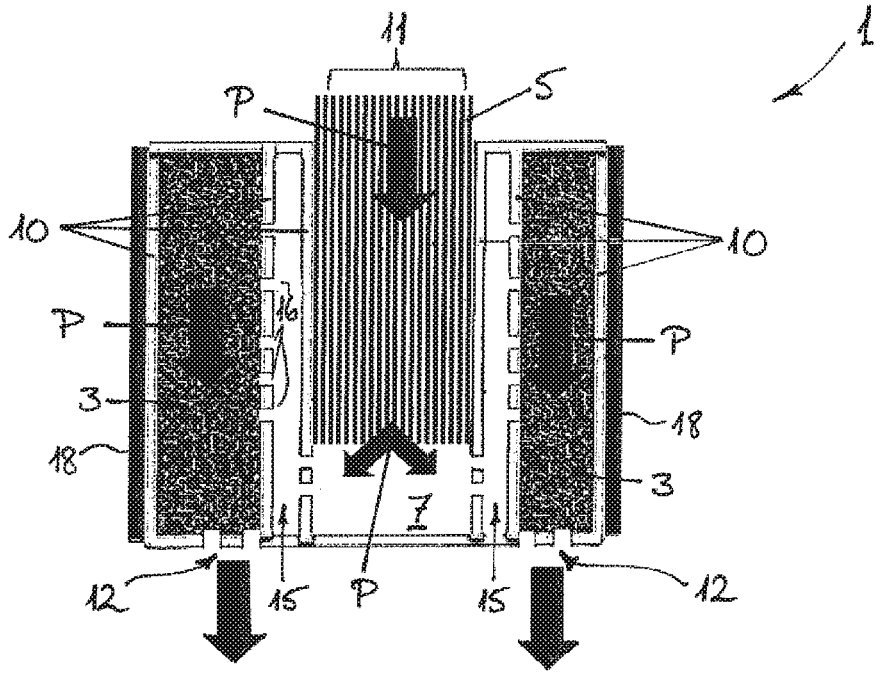
FIG. 5 is a cross-sectional view of a smoking article according to a fourth embodiment.

Referring now to FIG. 5 of the drawings, a further embodiment of a smoking article 1 according to the present invention is illustrated in cross-section. In this embodiment, in addition to a first air chamber 7 located below the heat source 4 or fuel element 5, a second annular or cylindrical air chamber 15 is provided laterally of and surrounding fuel element 5. In this embodiment, therefore, the air which has been heated in the channels 9 of the fuel element 5 continues to be heated as it passes through the second air chamber 15 in contact with the aluminium barrier layer 10. That is, as the sides 10 of the second air chamber 15 are of aluminium and in direct physical contact with the heat source 4, they conduct heat directly from the rod-like element 5 and continue to heat the airflow before it enters the tobacco material 3. This design of the second air chamber 15 enables the hot air to enter the body 2 of tobacco material 3 over the full vertical extent thereof via holes or perforations 16 in a wall of the second air chamber 15. In this way, the hot air entering the tobacco material 3 is well distributed throughout that material, and this tobacco material 3 again generates smoke for the water-pipe. In other words, the smoke generated continues on the path P as before to the outlet openings 12, where it exits the cartridge 1 and continues through the water-pipe for enjoyment by the user.

Figure 6:
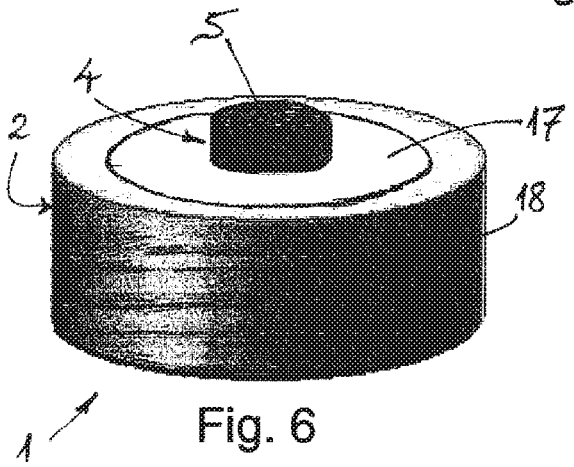
FIG. 6 is a schematic perspective view of a smoking article according to a fifth embodiment.

In FIG. 6 of the drawings, a further embodiment of a capsule- or cartridge-type smoking article 1 of the invention is shown in perspective view. This embodiment of the smoking article 1 is very similar to FIG. 1, but further includes a generally annular plate member 17 comprised of a thermally conductive material, such as aluminium, extending over an upper surface of the cartridge or capsule 1 for conducting heat from the heat source 4, again located centrally, in a radially outward direction to an upper part of the body 2 of tobacco material. This embodiment also includes an outer wrap or cover 18 of a thermally insulating material around the cylindrical body 2 to enable a user to handle the cartridge or capsule 1 in use without burning his/her fingers. The outer wrap or cover 18 may, for example, comprise paper in one or more layers over the peripheral barrier layer 10 of aluminium foil. Indeed, it will be noted that all of the embodiments described in the present application may (or do) include such an outer thermally insulating layer 18.

Figure 7:
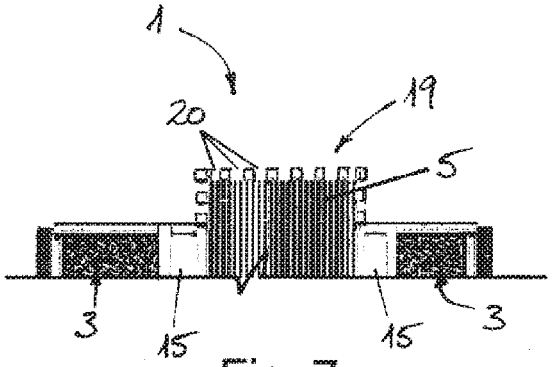
FIG. 7 is a cross-sectional view of part of a smoking article according to a sixth embodiment.

Referring to FIG. 7 of the drawings, a further modification (shown here with respect to the cartridge of FIG. 5) provides a protective cover 19, e.g. a mesh or screen, over the upper end region 6 of the heat source 4 or fuel element 5. This cover mesh or screen 19 has an array of holes or apertures 20 for passage of air into the fuel element 5, but nevertheless prevents a user from directly contacting the heated rod-like fuel element 5 during use. It is to be noted here that such a protective cover 19 may be applied in the other embodiments described herein.

Figure 8:
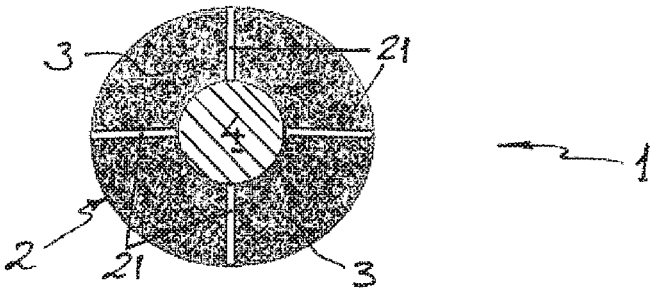
FIG. 8 is a schematic cross-sectional view of a smoking article according to a seventh embodiment.

FIG. 8 of the drawings shows a further modification in which heat transfer members 21, here formed as radially extending fins or radial plate members, are provided within the body 2 of smoking material 3 for heat transfer radially outwardly from the central heat source 4 into the tobacco material 3 to promote smoke generation.

Figure 9:
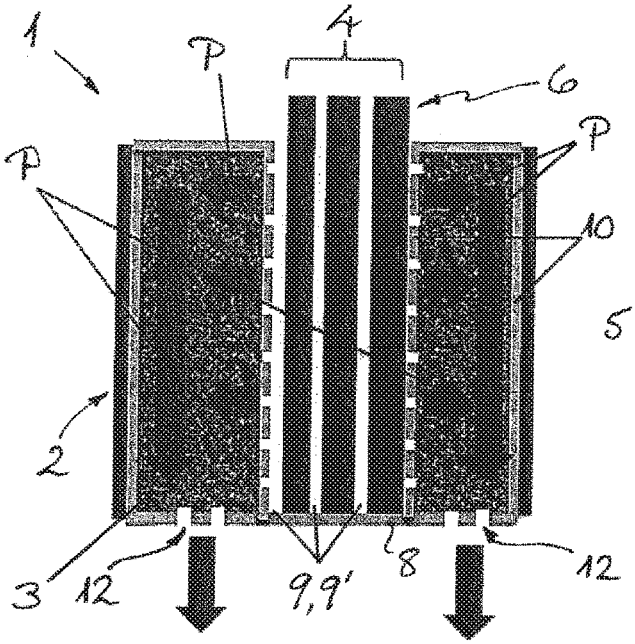
FIG. 9 is a cross-sectional view of a smoking article according to an eighth embodiment.
Figure 10:
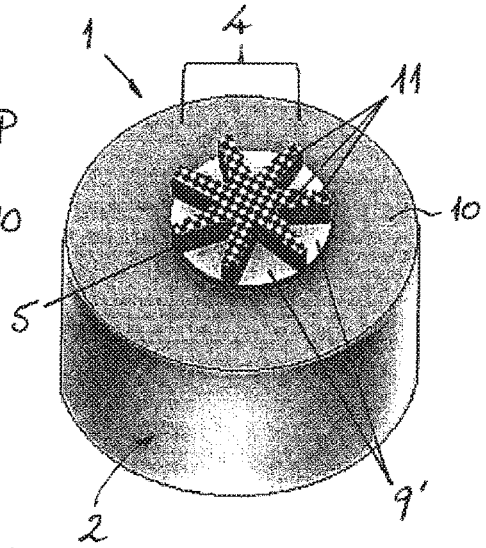
FIG. 10 is a schematic perspective view of the smoking article shown in FIG. 9.
Figure 11:
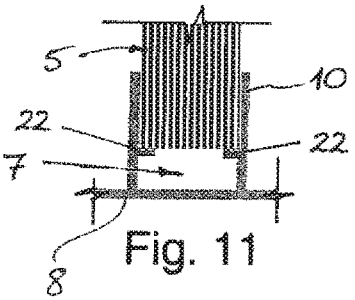
FIG. 11 is a schematic partial cross-sectional view that illustrates a support for the fuel element in any of the embodiments shown in FIGS. 1 to 5.
Figure 12:
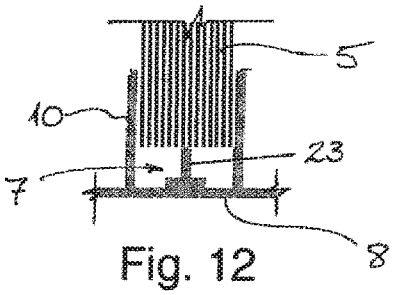
FIG. 12 is a schematic partial cross-sectional view that illustrates another support for the fuel element in any of the embodiments in FIGS. 1 to 5.
Figure 13:
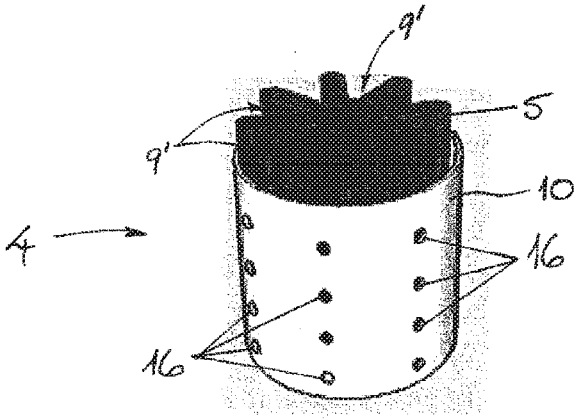
FIG. 13 is a schematic perspective view of a fuel element of the smoking article shown in FIGS. 9 and 10.

With reference now to FIGS. 9 to 13 of the drawings, another embodiment of a smoking article 1 according to this invention will be described. Specifically, FIGS. 9 and 10 illustrate this embodiment and it is firstly apparent that the rod-like fuel element 5 has a star-shaped longitudinal cross-section. In addition, however, it will be seen that the cartridge-like smoking article 1 of this embodiment does not include an air chamber below the fuel element 5, as in previous embodiments. In this regard, FIGS. 11 and 12 of the drawings show how the material of the barrier layer 10 in the previous embodiments of FIGS. 1 to 5 may be configured to provide a support, e.g. in the form of a shoulder or ledge 22 or an upstanding strut 23 for supporting the fuel element 5 above the base 8 of the body 2 and thereby also creating the air chamber 7. In the embodiment of FIGS. 9 and 10, by contrast, the fuel element 5 simply seats against the base 8 of the smoking article 1. As before, the fuel element 5 includes inlet openings 11 and air channels 9 for conveying a flow of air through and along the fuel element 5 and into the smoking material 3. In this case, the star-shaped fuel element 5 also forms channels 9' for air flow between the arms of the star-shaped cross-section, which together with the surrounding aluminium barrier layer 10 (see FIG. 13), effectively form lateral air chambers 15 through which air passes and is heated before entering the tobacco material 3 to be smoked through the holes 16 in the barrier layer 10.

Although specific embodiments of the invention have been illustrated and described herein, it will be appreciated by those of ordinary skill in the art that a variety of alternate and/or equivalent implementations exist. It should be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

In this document, the terms "comprise", "comprising", "include", "including", "contain", "containing", "have", "having", and any variations thereof, are intended to be understood in an inclusive (i.e. a non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and an used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

The invention claimed is:

1. A smoking article, comprising:

a body of smoking material; and a heat source provided or embedded in the body for heating the body of smoking material, the heat source including a plurality of channels;

wherein the smoking article defines an airflow path through the plurality of channels for air to be heated by the heat source and through the body of smoking material, wherein the heat source is physically separated from the body of smoking material by a barrier layer, wherein an air chamber is arranged in the airflow path between the heat source and the body of smoking material, wherein the air chamber is located below and/or laterally of the heat source and is in fluid communication with the body of smoking material via holes or perforations in the barrier layer, and wherein the body of smoking material includes at least one baffle member for direction airflow through the body of smoking material along the airflow path.

2. The smoking article according to claim 1, wherein the at least one baffle member is configured for directing airflow from the air chamber in a convoluted manner along the airflow path through the body of smoking material.

3. The smoking article according to claim 1, wherein the heat source is substantially surrounded or encompassed by the body of smoking material.

4. The smoking article according to claim 1, wherein the heat source is substantially centrally located in the body of smoking material.

5. The smoking article according to claim 1, wherein the body of smoking material is wrapped or covered with a protective barrier layer or film.

6. The smoking article according to claim 1, wherein an outer end region of the plurality of channels of the heat source include a cover or screen to prevent direct contact therewith by a user, the cover or screen including holes or apertures forming part of the airflow path.

7. The smoking article according to claim 1, wherein the heat source includes at least one heat transfer member that extends into the body of smoking material for conducting heat thereto.

8. The smoking article according to claim 1, wherein the smoking article is formed as a cartridge, pellet or capsule.

9. The smoking article according to claim 1, wherein the body of smoking material comprises tobacco.

10. The smoking article according to claim 1, wherein the heat source is a fuel element.

11. The smoking article according to claim 1, wherein the barrier layer comprises an aluminum foil.

12. The smoking article according to claim 4, wherein the body of smoking material is substantially cylindrical in shape.

13. The smoking article according to claim 5, wherein the protective barrier layer or film comprises a metal foil.

14. The smoking article according to claim 6, further comprising an outer thermally insulating layer.

15. The smoking article according to claim 14, wherein the outer thermally insulating layer comprises paper.

16. The smoking article according to claim 7, wherein the at least one heat transfer member comprises a fin or a plate.

17. The smoking article according to claim 13, wherein the protective barrier layer or film further comprises an outer thermally insulating layer.

18. The smoking article according to claim 17, wherein the outer thermally insulating layer comprises paper.

19. The smoking article according to claim 10, wherein the fuel element is a combustible substance.

20. The smoking article according to claim 19, wherein the combustible substance is charcoal.

21. The smoking article according to claim 1, wherein the air chamber is located downstream of the heat source and upstream of the body of smoking material.

* * * * *